US007625072B2

(12) United States Patent
Saito et al.

(10) Patent No.: US 7,625,072 B2
(45) Date of Patent: Dec. 1, 2009

(54) INK JET RECORDING HEAD AND RECORDING APPARATUS

(75) Inventors: Riichi Saito, Fujisawa (JP); Yasutomo Watanabe, Hiratsuka (JP); Toshiaki Hirosawa, Hiratsuka (JP); Shuzo Iwanaga, Kawasaki (JP); Akira Yamamoto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 435 days.

(21) Appl. No.: 11/597,417

(22) PCT Filed: Jul. 15, 2005

(86) PCT No.: PCT/JP2005/013523

§ 371 (c)(1),
(2), (4) Date: Nov. 22, 2006

(87) PCT Pub. No.: WO2006/009265

PCT Pub. Date: Jan. 26, 2006

(65) Prior Publication Data

US 2008/0068423 A1 Mar. 20, 2008

(30) Foreign Application Priority Data

Jul. 22, 2004 (JP) ..... 2004-214238

(51) Int. Cl.
*B41J 2/05* (2006.01)

(52) U.S. Cl. ..... 347/63; 347/64; 347/67

(58) Field of Classification Search ..... 347/17, 347/18, 20, 56, 61–65, 67
See application file for complete search history.

(56) References Cited

U.S. PATENT DOCUMENTS

| | | | | |
|---|---|---|---|---|
| 5,066,964 | A * | 11/1991 | Fukuda et al. | 347/18 |
| 5,220,345 | A | 6/1993 | Hirosawa | 346/1.1 |
| 5,576,748 | A | 11/1996 | Tamura | 347/58 |
| 5,646,659 | A | 7/1997 | Moriyama et al. | 347/55 |
| 5,916,452 | A | 6/1999 | Kobayashi et al. | 216/27 |
| 6,137,510 | A | 10/2000 | Sato et al. | 347/63 |
| 6,257,703 | B1 | 7/2001 | Hirosawa et al. | |
| 6,464,338 | B1 | 10/2002 | Morita et al. | 347/49 |
| 6,471,901 | B1 | 10/2002 | Kawamura et al. | 264/267 |
| 6,536,868 | B1 | 3/2003 | Kawamura et al. | 347/40 |
| 2002/0043742 | A1 | 4/2002 | Kawamura et al. | 264/267 |
| 2002/0060726 | A1 | 5/2002 | Udagawa et al. | 347/93 |
| 2002/0071002 | A1 | 6/2002 | Kawamura et al. | 347/50 |
| 2003/0058308 | A1 | 3/2003 | Yamamoto | |

FOREIGN PATENT DOCUMENTS

| | | |
|---|---|---|
| JP | 10-44420 | 2/1998 |
| JP | 2002-254644 | 9/2002 |
| JP | 2003-170597 | 6/2003 |
| JP | 2004-71597 | 3/2004 |

* cited by examiner

*Primary Examiner*—Juanita D Stephens
(74) *Attorney, Agent, or Firm*—Fitzpatrick, Cella, Harper & Scinto

(57) ABSTRACT

In order to dissipate to a high degree of efficiency the heat of a liquid discharge substrate of an ink jet recording head and effectively suppress increases in the substrate temperature, in an ink jet recording head in which a liquid discharge substrate is mounted on a supporting member through a foil-shaped heat dissipation member, the area of the heat dissipation member is greater than the projected area of the liquid discharge substrate with respect to the supporting member.

6 Claims, 13 Drawing Sheets

INK JET RECORDING HEAD AND RECORDING APPARATUS

TECHNICAL FIELD

The present invention relates to a recording head that discharges liquids such as ink (hereunder, referred to collectively as "ink") in accordance with input electrical signals.

BACKGROUND ART

As one kind of ink jet recording head, a recording head is known that discharges ink droplets utilizing energy generated by an electrothermal converting element. In this kind of recording head, as shown in FIG. 13, a silicon liquid discharge substrate 204 that comprises a discharge port 200 which discharges ink droplets, a liquid chamber 201 in which ink discharged from the discharge port 200 is temporarily accumulated, liquid supply ports 202 which communicate with the liquid chamber 201, and electrothermal converting elements 203 which impart discharge energy to the ink in the liquid chamber 201 is mounted in an integrated condition on an alumina supporting member 205. More specifically, the underside of the liquid discharge substrate 204 and the top surface of the supporting member 205 are directly bonded by an epoxy bonding agent 206 and, through an ink channel formed by the opposing boundary surfaces 207 of the bonding agent 206, the liquid supply port 202 of the liquid discharge substrate 204 communicates with a liquid supply hole 208 that is provided in the supporting member 205 (for a more detailed description, for example, refer to the ink jet recording head described in Japanese Patent Application Laid-Open No. H10-44420).

The electrothermal converting element 203 generates a phase change in the ink inside the liquid chamber 201 by imparting thermal energy to the ink, thereby causing minute ink droplets to be discharged from the discharge port 200 by the pressure of air bubbles generated in the ink at that time. Surplus heat is transmitted to the supporting member 205 through the liquid discharge substrate 204 and dissipated.

In this type of ink jet recording head, because ink droplets are discharged utilizing the pressure of air bubbles generated when ink develops into foams, when the temperature of the liquid discharge substrate becomes high the discharge control becomes difficult, resulting in disadvantages such as the erroneous discharge of ink droplets. Therefore, conventional ink jet recording apparatuses are equipped with a mechanism that temporarily suspends discharge operations when the temperature of the liquid discharge substrate has become high. Meanwhile, there is an ever-growing trend towards densification of electrothermal converting elements in order to respond to demands for high-speed recording at higher resolutions, and the electrical power consumption of electrothermal converting elements is also continuing to increase. As a result, the temperatures of liquid discharge substrates during operation are tending to increase, and if this trend continues it is anticipated that the recording heads will frequently fall into a suspended state during operation.

DISCLOSURE OF THE INVENTION

An object of this invention takes into consideration the circumstances described above, and is directed at efficiently releasing the heat of a liquid discharge substrate to effectively suppress increases in the substrate temperature.

Another object of this invention is to provide an ink jet recording head having a supporting member comprising a liquid supply hole; and a liquid discharge substrate comprising a liquid supply port that communicates with the liquid supply hole, a discharge port from which liquid that was supplied from the liquid supply port is discharged, and a discharge energy generation means that generates energy for discharging the liquid from the discharge port; wherein, the liquid discharge substrate is mounted on a supporting member through a heat dissipation member, and the area of the heat dissipation member is larger than the projected area of the liquid discharge substrate that faces the supporting member. A further object of this invention is to provide an ink jet recording apparatus that uses this ink jet recording head.

BEST MODES FOR CARRYING OUT THE INVENTION

Figure 1:
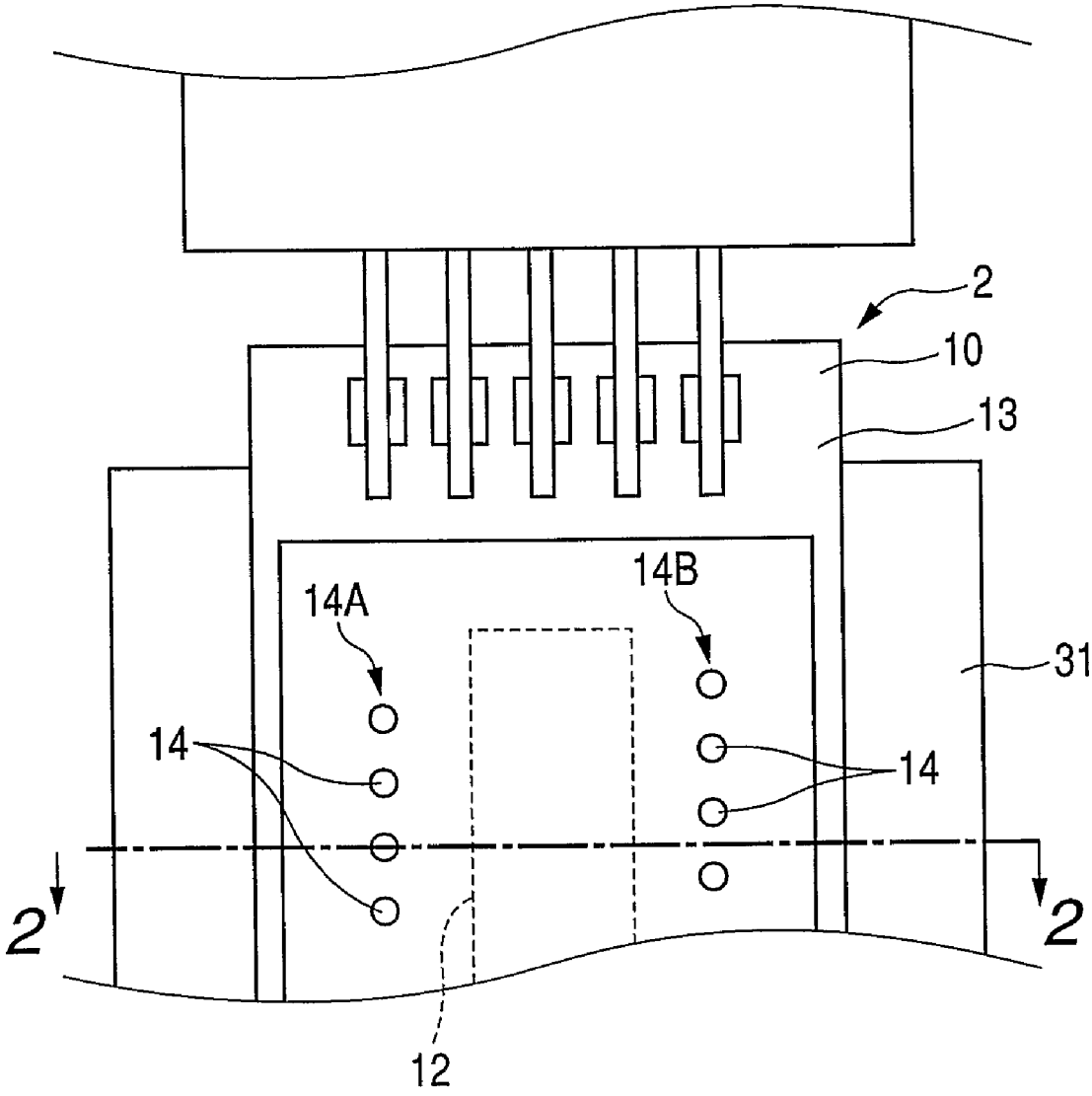
FIG. 1 is a schematic plan view showing one example of an embodiment of the recording head of this invention.

The embodiments of this invention described hereunder are apparatuses that efficiently dissipate heat generated from a liquid discharge substrate by disposing between a supporting member and a liquid discharge substrate a foil-shaped heat dissipation member having an area that is larger than the projected area of the liquid discharge substrate with respect to the supporting member. More specifically, one side of the liquid discharge substrate mounted on top of the supporting member faces the external surface of the supporting member. Thus, the invention is directed at increasing the heat dissipating efficiency of the apparatus by diffusing over a wide area heat generated from the liquid discharge substrate, by disposing between the external surface of the supporting member and the external surface (opposing surface) of the liquid discharge substrate with respect to the external surface of the supporting member a heat dissipation member having an area that is larger than the opposing surface. In this connection, when the aforementioned foil-shaped heat dissipation member with an area larger than the opposing surface is disposed between the supporting member and the liquid discharge substrate, normally the entire circumference of the heat dissipation member extends to outside of the liquid discharge substrate. However, depending on the relative location or aspect ratio of the heat dissipation member with respect to the liquid discharge substrate, there are also cases where one part of the circumference of the heat dissipation member is concealed below the liquid discharge substrate. Naturally, even if one part of the circumference of the heat dissipation member is concealed below the liquid discharge substrate, the objects of this invention are achieved as long as the area of the heat dissipation member satisfies the above condition. Likewise, even in a case where a notch or a slit is formed in one part of the heat dissipation member, the objects of this invention are achieved as long as the area of the heat dissipation member satisfies the above condition. Further, even when two or more heat dissipation members are provided or a heat dissipation member is separated into two or more parts and heat conduction is possible between the two or more heat dissipation members, the objects of the invention are achieved as long as the apparatus is one in which the total area of these heat dissipation members satisfies the aforementioned condition. Furthermore, although copper foil is exemplified as a heat dissipation member in each of the following embodiments, the heat dissipation member is not limited to a foil-shaped member and it may be a sheet-shaped member with a thickness that is greater than a member that is generally referred to as foil. In addition, the material for the heat dissipation member may be material at least having thermal conductivity more excellent than the adhesive and the supporting member used therein. Moreover, the material for the heat dissipation member may be material having thermal conductivity more excellent than the liquid discharge substrate.

By contacting the aforementioned liquid discharge substrate and heat dissipation member through a bump, the heat conduction efficiency from the liquid discharge substrate to the heat dissipation member can be increased and the heat dissipating characteristics can also be enhanced. In addition, by providing a metal film on the liquid discharge substrate and contacting the metal film and the heat dissipation member through a bump, the heat conduction efficiency can be increased even more.

EMBODIMENT 1

Figure 2:
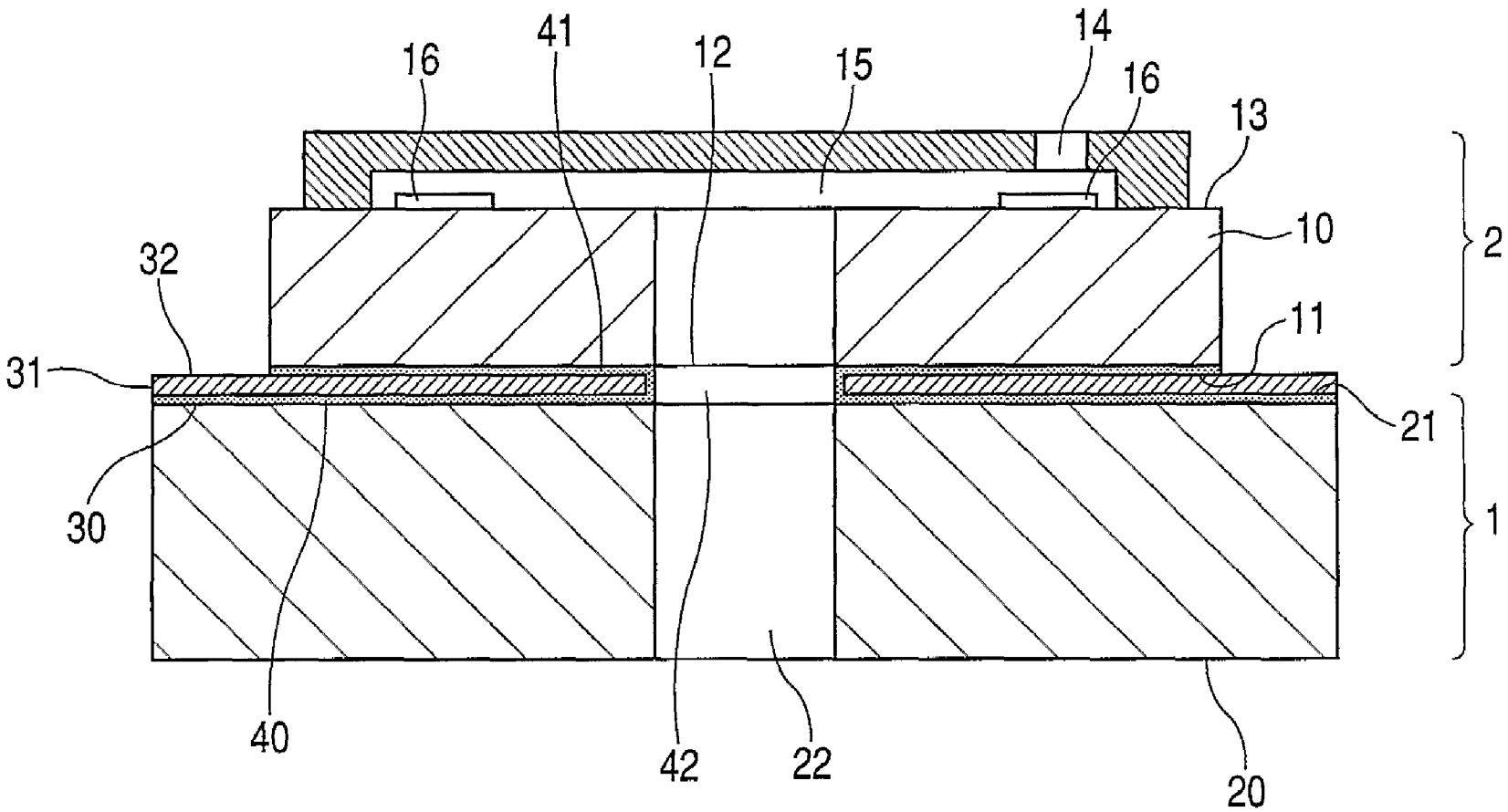
FIG. 2 is a schematic sectional view of a section cut along the line 2-2 shown in FIG. 1 of the recording head shown in the same figure.
Figure 3:
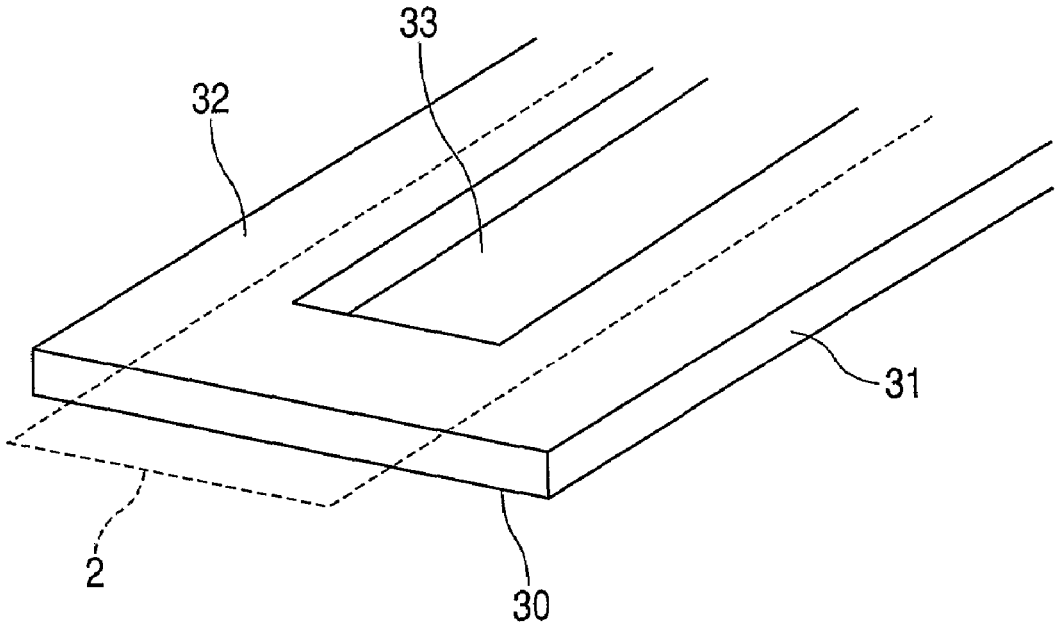
FIG. 3 is a schematic oblique perspective view of a copper foil shown in FIG. 1.

Hereunder, an example of one embodiment of the recording head of this invention is described referring to FIGS. 1 to 3. FIG. 1 is a schematic plan view showing one part of the recording head of this example, and FIG. 2 is a schematic sectional view along the line 2-2 shown in FIG. 1.

As shown in FIG. 1 and FIG. 2, the recording head of this example is composed of a supporting member 1 and a liquid discharge substrate 2 mounted on top of the supporting member 1. On the liquid discharge substrate 2, a liquid supply port 12 is formed on an underside 11 of a silicon substrate main body 10, a discharge port 14 is formed at the side of a top surface 13, a liquid chamber 15 is formed between the liquid supply port 12 and the discharge port 14, and electrothermal converting elements 16 are formed inside the liquid chamber 15. More specifically, in the center in the width direction of the underside 11 of the substrate main body 10, the liquid supply port 12 is formed in an elongated condition along the lengthwise direction of the substrate main body 10. Further, on the side of the top surface 13 of the substrate main body 10 are formed two discharge port rows 14A and 14B that respectively comprise a plurality of the discharge ports 14 disposed in a row along the lengthwise direction of the substrate main body 10. It will be understood from FIG. 1 that each of the discharge ports 14 comprising the discharge port row 14A are out of alignment by half pitch with each of the discharge ports 14 comprising the other discharge port row 14B. Further, it will be understood from FIG. 1 that the two discharge port rows 14A and 14B are disposed on the two outer sides in the width direction of the liquid supply port 12.

The supporting member 1 is made from alumina and, as shown in FIG. 2, a liquid supply hole 22 is formed that penetrates from an underside 20 to a top surface 21. The liquid discharge substrate 2 is mounted on the top surface 21 of the supporting member 1 through a copper foil 31 that functions as a foil-shaped heat dissipation member. More specifically, the underside 11 of the liquid discharge substrate 2 is bonded to a top surface 32 of the copper foil 31 that has an underside 30 bonded to the top surface 21 of the supporting member 1. Here, the copper foil 31 has a frame-shaped planar form with a roughly rectangular opening 33 formed in the center thereof (FIG. 3). The inside edges of the opening 33 are sealed by a bonding agent 40 that bonds the top surface 21 of the supporting member 1 and the underside 30 of the copper foil 31 and a bonding agent 41 that bonds the top surface 32 of the copper foil 31 and the underside 11 of the liquid discharge substrate 2. An ink channel 42 is formed between the liquid supply hole 22 and the liquid supply port 12 by the boundary surfaces of the bonding agents 40 and 41.

The area of the copper foil 31 is larger than the projected area of the liquid discharge substrate 2 with respect to the top surface 21 of the supporting member 1, and as illustrated most clearly in FIG. 1, the circumferential part of the copper foil 31 extends to outside of the liquid discharge substrate 2.

According to the recording head of this example having the above structure, heat of the liquid discharge substrate 2 is conducted to the copper foil 31 and diffused throughout the entire copper foil 31 to dissipate, and also conducted to the supporting member 1 to dissipate. More specifically, because heat of the liquid discharge substrate 2 is diffused by the copper foil 31 that has an area larger than the underside 11 of the substrate 2, heat dissipating characteristics are realized that are superior to those of a structure in which the underside 11 of the liquid discharge substrate 2 is bonded directly to the top surface 21 of the supporting member 1. Furthermore, with respect to the operational effects, it will be understood that the material of the heat dissipation member is not limited to copper, and any material may be used as long as it is a material with better heat conductivity than at least the bonding agents 40, 41 and the supporting member 1. Moreover, it is preferable that the heat dissipation member is a material with better heat conductivity than the liquid discharge substrate 2. In addition, similarly, the material for the supporting member 1 is not limited to alumina and the material for the liquid discharge substrate 2 is not limited to silicon. This is also applicable to the embodiments described hereinafter.

The bonding agent 41 that bonds the underside 11 of the liquid discharge substrate 2 and the top surface 32 of the copper foil 31 has thermal resistance that inhibits heat conduction from the liquid discharge substrate 2 to the copper foil 31. Further, the bonding agent 40 that bonds the underside 30 of the copper foil 31 and the top surface 21 of the supporting member 1 has thermal resistance that inhibits heat conduction from the copper foil 31 to the supporting member 1. Accordingly, it is preferable from the viewpoint of enhancing the heat dissipation characteristics to decrease as much as possible the aforementioned thermal resistance by reducing the thickness of the bonding agents 40 and 41 or using a bonding agent with favorable heat dissipation characteristics. For example, the thickness of the bonding agent 40 is preferably 10 μm or less.

EMBODIMENT 2

Figure 4:
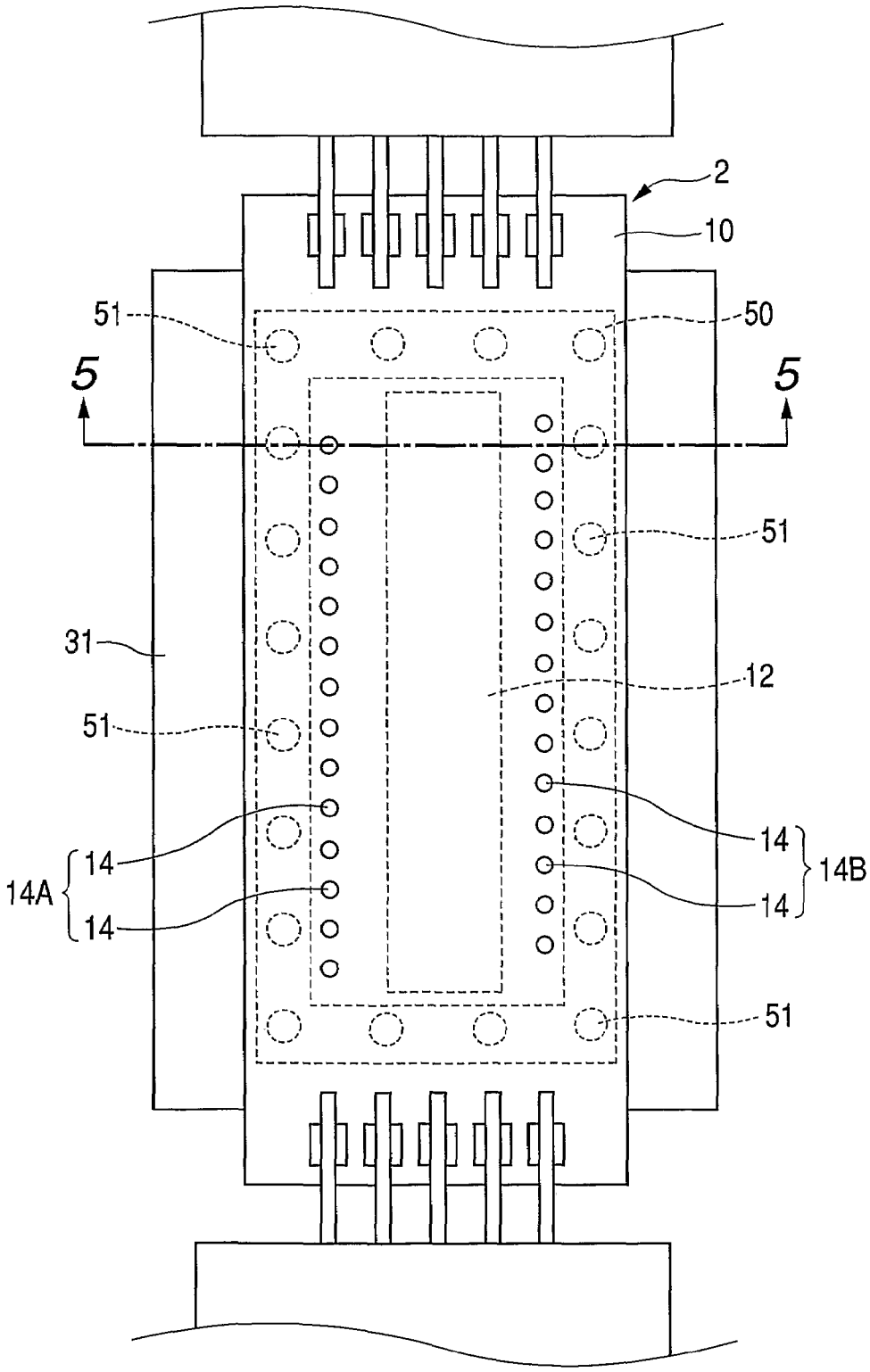
FIG. 4 is a schematic plan view showing another example of an embodiment of the recording head of this invention.
Figure 5:
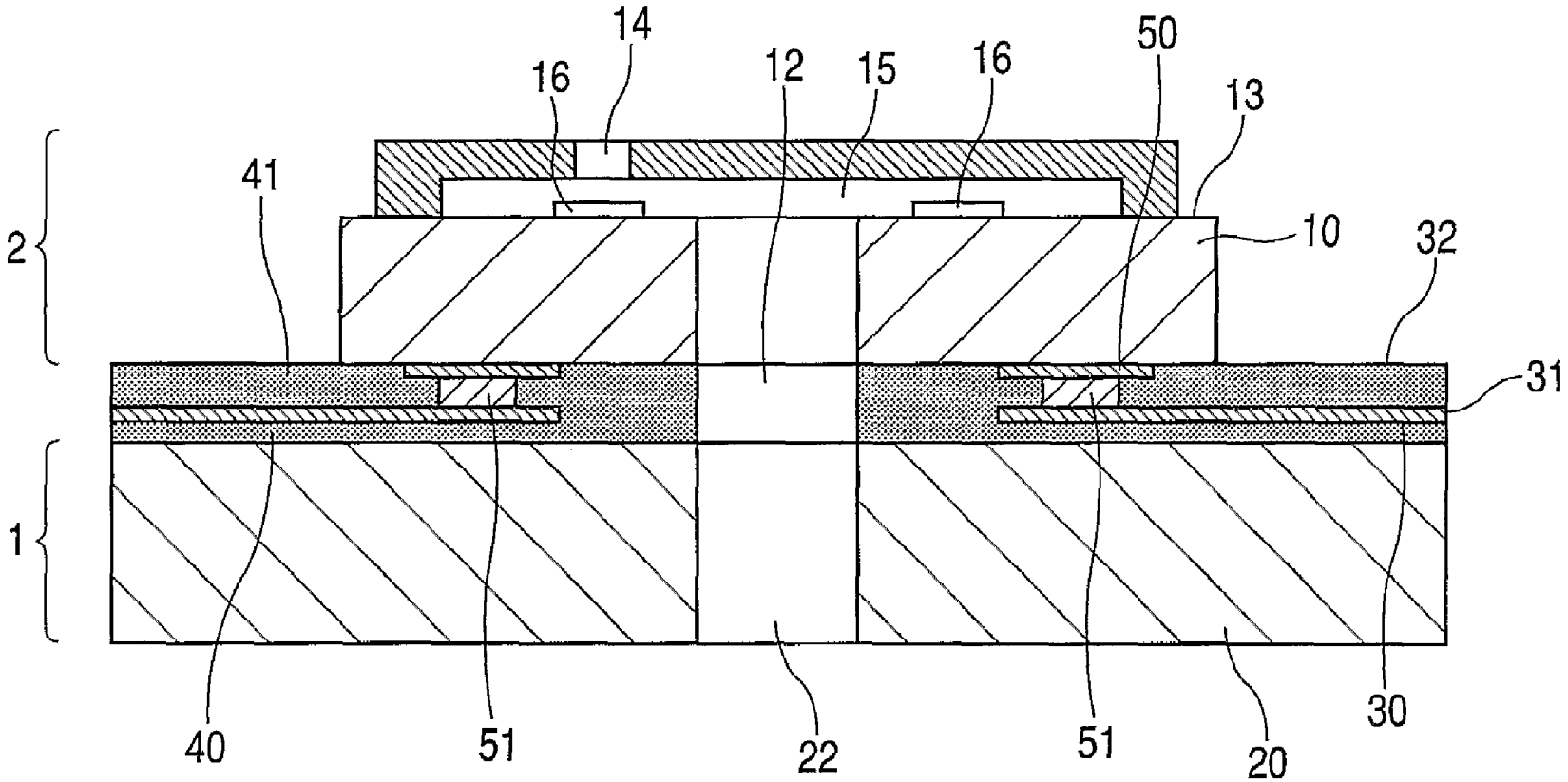
FIG. 5 is a schematic sectional view of a section cut along the line 5-5 shown in FIG. 4 of the recording head shown in the same figure.

Hereunder, another example of an embodiment of the recording head of this invention is described referring to FIG. 4 and FIG. 5. FIG. 4 is a schematic plan view of the recording head of this example, and FIG. 5 is a schematic sectional view along the line 5-5 of FIG. 4. The basic structure of the recording head of this example is the same as that of the recording head of Embodiment 1. Therefore, the parts of the structure in FIG. 4 and FIG. 5 that are common with the recording head of Embodiment 1 are denoted by the same symbols as in Embodiment 1, and a description of these parts is omitted here.

The difference between the recording head of this example and the recording head of Embodiment 1 is the structure of the bond between the liquid discharge substrate 2 and the copper foil 31. More specifically, a metallic thin film 50 is formed on the underside 11 of the liquid discharge substrate 2, and the thin film 50 and the top surface 32 of the copper foil 31 are bonded through a plurality of heat-dissipating bumps 51. As illustrated most clearly in FIG. 4, the thin film 50 is formed so as to surround the circumference of the liquid supply port 12, and the heat-dissipating bumps 51 are formed in a roughly evenly spaced condition on the thin film 50.

According to the recording head of this example having the above structure, the heat conduction efficiency from the liquid discharge substrate 2 to the copper foil 31 is increased and more favorable heat dissipation characteristics are obtained. In this connection, with regard to the aforementioned operational effects of the thin film 50 and the heat-dissipating bumps 51, the materials of the thin film 50 and the heat-dissipating bumps 51 are not limited to specific materials, and it will be understood that any materials may be used as long as they are materials that have better heat conductivity than the bonding agents 40 and 41. For example, although in this example the material of the thin film 50 is aluminum, the thin film 50 may be formed by gold. Further, although in this example the heat-dissipating bumps 51 are solder bumps, they can be substituted with gold bumps. Furthermore, although according to this example the thin film 50 is formed only on one part (circumference of the liquid supply port 12) of the underside 11 of the liquid discharge substrate 2, it is possible to further enhance the heat dissipation characteristics by expanding the area of the thin film 50 or increasing the number of the heat-dissipating bumps 51.

EMBODIMENT 3

Hereunder, a further example of an embodiment of the recording head of this invention is described. The basic structure of the recording head of this example is the same as that of the recording head of Embodiment 1. The difference between the recording head of this embodiment and the recording head of Embodiment 1 is that the copper foil as a heat dissipation member is formed on a film-shaped electric circuit board (hereunder, referred to as "flexible printed circuit") on which wiring patterns for supplying driving signals or the like to electrothermal converting elements were formed. Therefore, after giving a general description of the structure of the flexible printed circuit comprising the recording head of this example referring to FIG. 6, the structure of the recording head of this example will be described referring to FIG. 7 and FIG. 8. The supporting member and the liquid discharge substrate comprising the recording head of this example are the same as those in the recording head of Embodiment 1. Therefore, the supporting member and the liquid discharge substrate are denoted by the same symbols in FIG. 7 and FIG. 8 as in Embodiment 1, and a description of these is omitted here.

Figure 6:
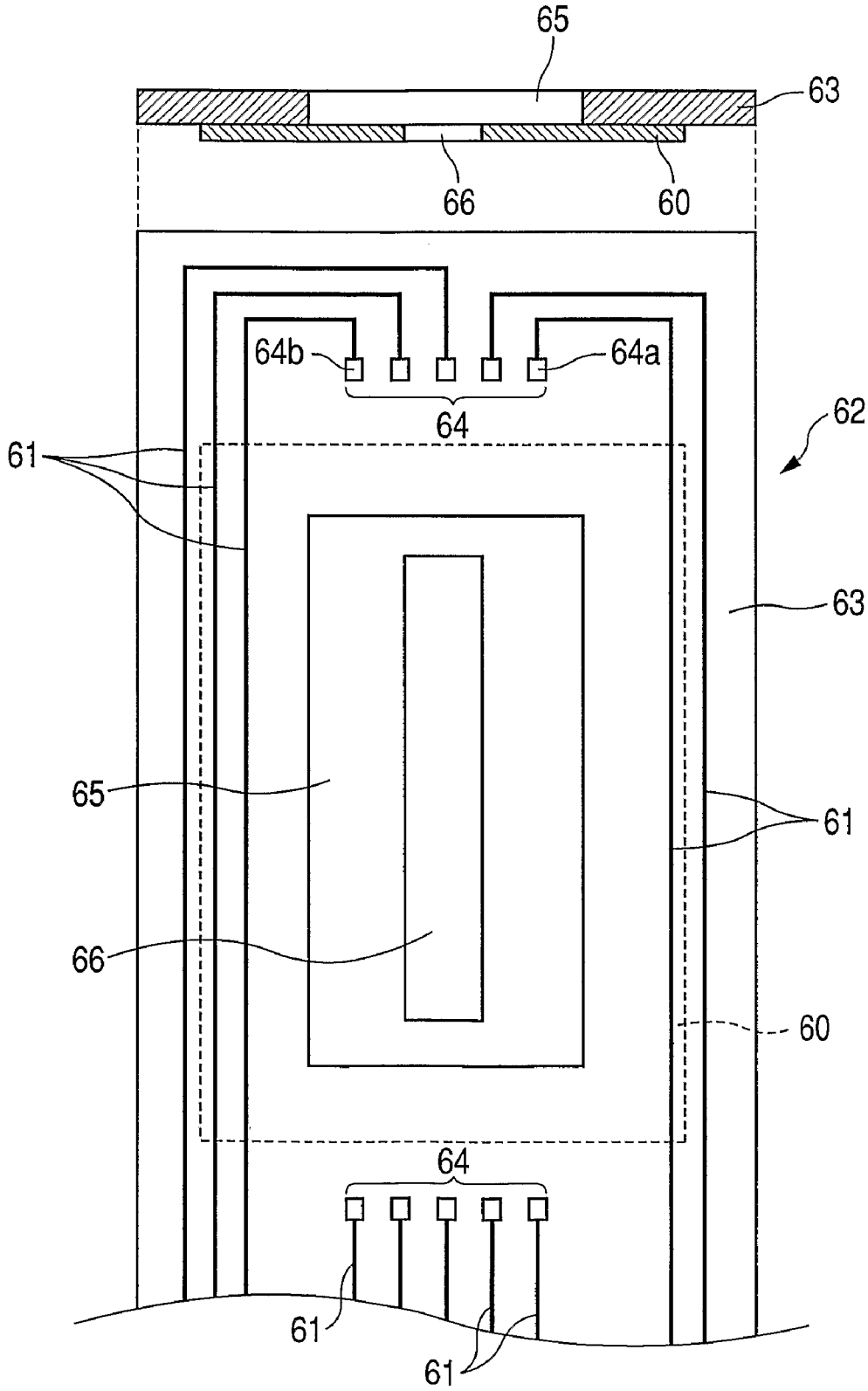
FIG. 6 is a schematic plan view showing one example of a flexible printed circuit.
Figure 7:
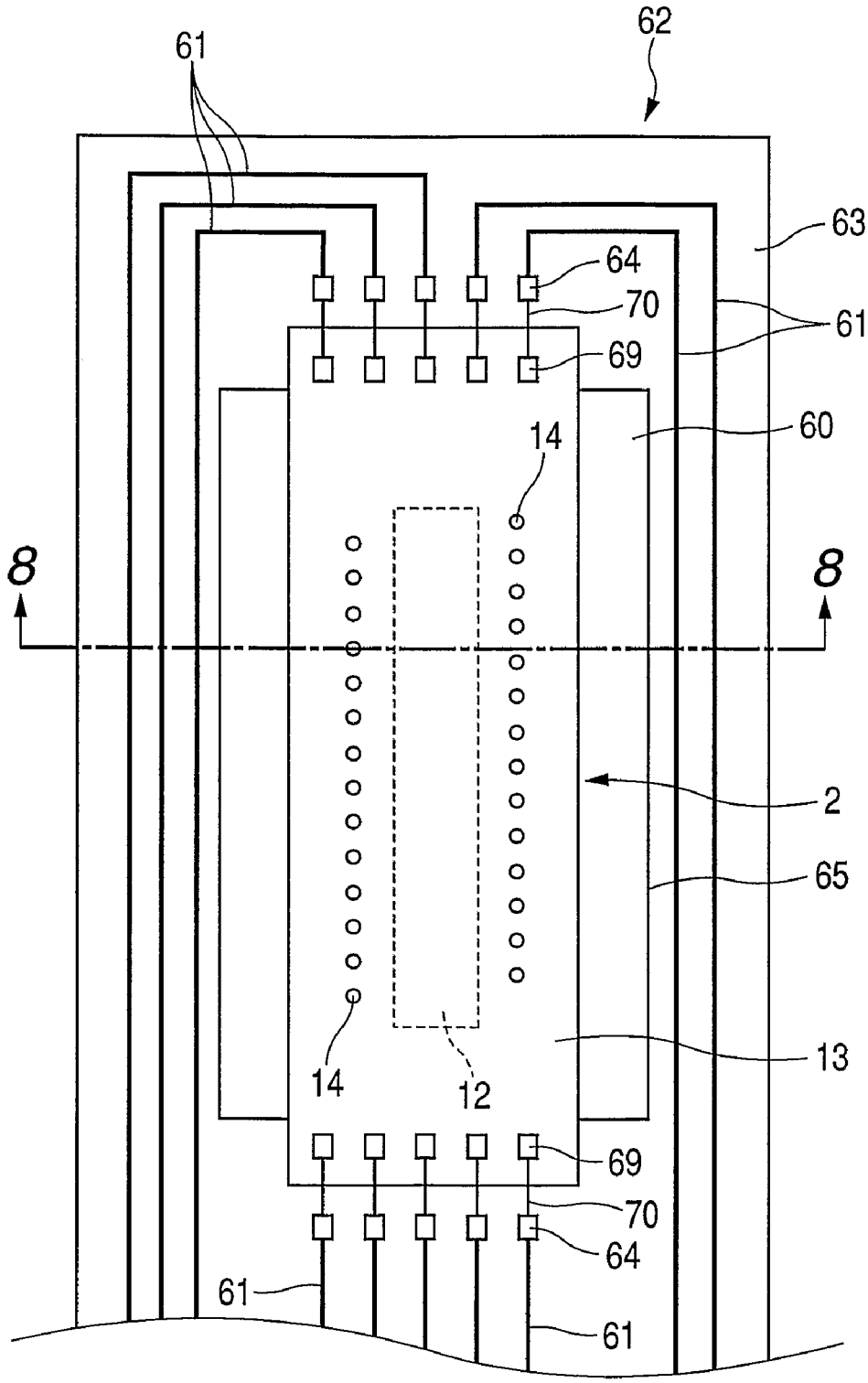
FIG. 7 is a schematic plan view showing another example of an embodiment of the recording head of this invention.

A flexible printed circuit 62 shown in FIG. 6 comprises a base film 63, wiring patterns 61 and electrode terminals 64 that are formed on the base film 63, and a copper foil 60 formed on the underside of the base film 63. An elongated rectangular hole 65 is formed in the lengthwise direction in the center in the width direction of the base film 63, and the wiring patterns 61 are formed so as to surround the rectangular hole 65. The electrode terminals 64 are disposed along the width direction of the base film 63 on the two external sides in the lengthwise direction of the rectangular hole 65 to form rows of electrodes, and each electrode terminal is electrically conducting with the corresponding wiring pattern 61. Further, in the copper foil 60 is formed an opening 66 that communicates with the rectangular hole 65 of the base film 63. Further, the copper foil 60 has an area larger than that of the liquid discharge substrate 2 as shown in FIGS. 7 and 8 so that the heat of the liquid discharge substrate 2 can be dispersed and transferred to the supporting member 1 for heat dissipation.

Next, the structure of the recording head of this example will be described referring to FIG. 7 and FIG. 8. FIG. 7 is a schematic plan view showing the recording head of this example, and FIG. 8 is a schematic sectional view along the line 8-8 of FIG. 7. As shown in these drawings, in the recording head of this example the liquid discharge substrate 2 is mounted on the supporting member 1 through the flexible printed circuit 62 having the above-described structure. More specifically, the underside of the base film 63 of the flexible printed circuit 62 and an underside 67 of the copper foil 60 are bonded to the top surface 21 of the supporting member 1 by the bonding agent 40, and the underside 11 of the liquid discharge substrate 2 is bonded to a top surface 68 of the copper foil 60 that is exposed from the rectangular hole 65 by the bonding agent 41. In this connection, each of the electrode terminals 64 of the flexible printed circuit 62 are connected to surface electrodes 69 formed on the top surface 13 of the liquid discharge substrate 2 through a wire bonding 70.

It is also possible to form a metallic thin film on the underside 11 of the liquid discharge substrate 2 and bond the thin film with the copper foil 60 through the heat-dissipating bumps. That is, the bonding structure described in Embodiment 2 can also be employed for the recording head of this example. Further, when providing electrodes (underside electrodes) on the underside of the liquid discharge substrate 2 and bringing the underside electrodes into conduction with the surface electrodes 69 through electrodes that penetrate the substrate 2 (penetrating electrodes), the aforementioned metallic thin film can be utilized as an underside electrode. For example, it is possible to utilize the aforementioned metallic thin film as an underside electrode by connecting the metallic thin film and the penetrating electrodes through bumps. At that time, the aforementioned heat-dissipating bumps may be used as the bumps that bring the metallic thin film into conduction with the penetrating electrodes, or bumps for electrical connection may be used that are provided separately to the heat-dissipating bumps.

Figure 8:
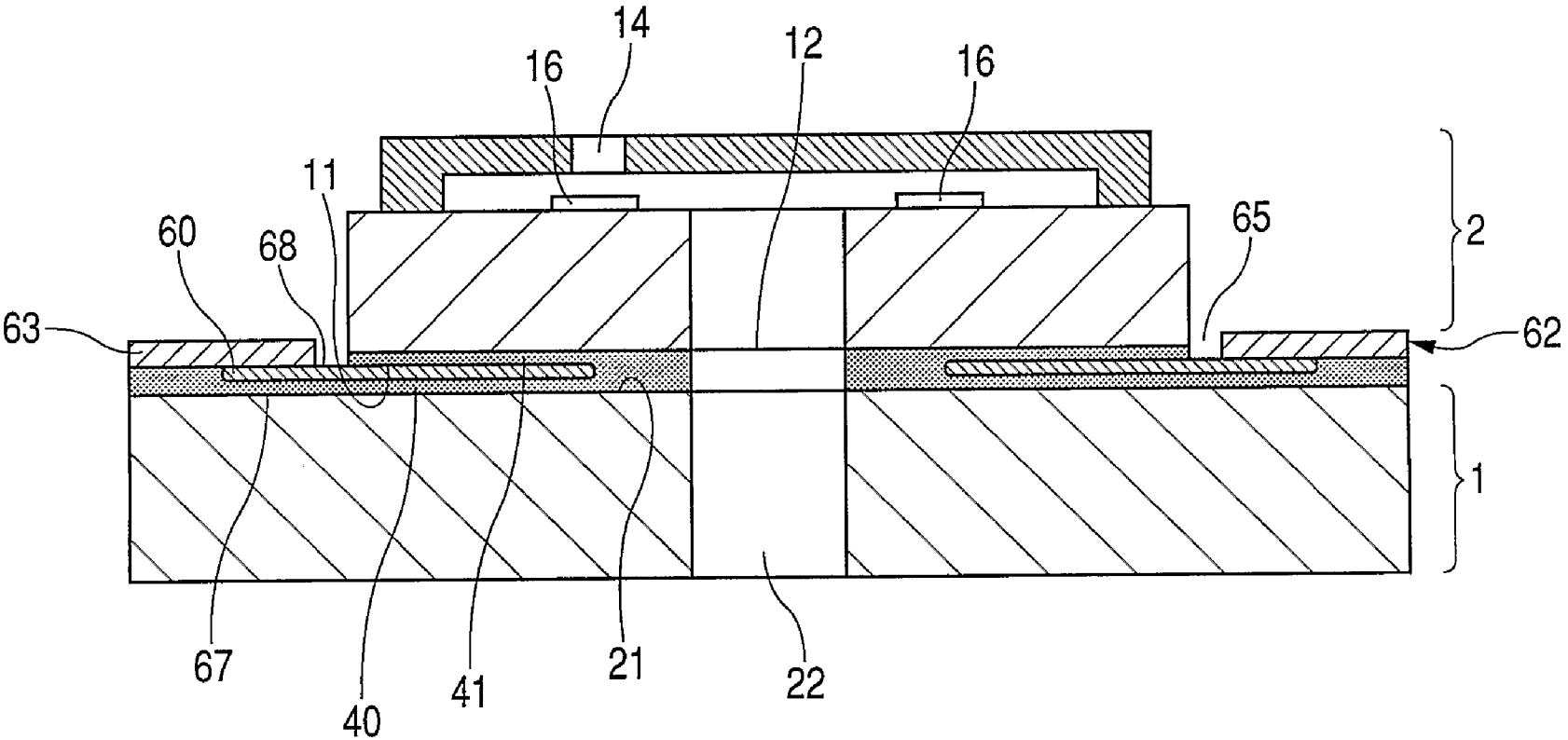
FIG. 8 is a schematic sectional view of a section cut along the line 8-8 shown in FIG. 7 of the recording head shown in the same figure.

Furthermore, as shown in FIG. 8, when a cover film or the like with a thickness that is thicker than the copper foil 60 is provided on the underside (side on which the copper foil 60 is formed) of the base film 63 of the flexible printed circuit 62, the bonding agent 41 provided between the underside 67 of the copper foil 60 and the top surface 21 of the supporting member 1 becomes thicker. It will be readily understood that the thicker the bonding agent 41 becomes, the greater the inhibition of heat conduction from the copper foil 60 to the supporting member 1. Thus, it is preferable not to provide a cover film on the underside of the base film 63, or even if a cover film is provided, preferably the thickness thereof is one that does not protrude more to the side of the top surface 21 of the supporting member 1 than the underside 67 of the copper foil 60.

EMBODIMENT 4

Hereunder, a further embodiment of the recording head of this invention is described. The recording head of this example is the same as the recording head of Embodiment 3 in the respect that a liquid discharge substrate is mounted on a supporting member via a flexible printed circuit on which a copper foil was formed as a heat dissipation member. The difference between the recording head of this example and that of Embodiment 3 is that a plurality of liquid discharge substrates is mounted on a single flexible printed circuit. Thus, after giving a general description of the structure of the flexible printed circuit comprising the recording head of this example referring to FIG. 9, the structure of the recording head of this example will be described referring to FIG. 10 and FIG. 11. The structure of each of the liquid discharge substrates is common with that of the liquid discharge substrate 2 comprising the recording head of Embodiment 1. Therefore, the liquid discharge substrates are denoted by the same symbols in FIG. 10 and FIG. 11 as in Embodiment 1, and a description of these is omitted here.

Figure 9:
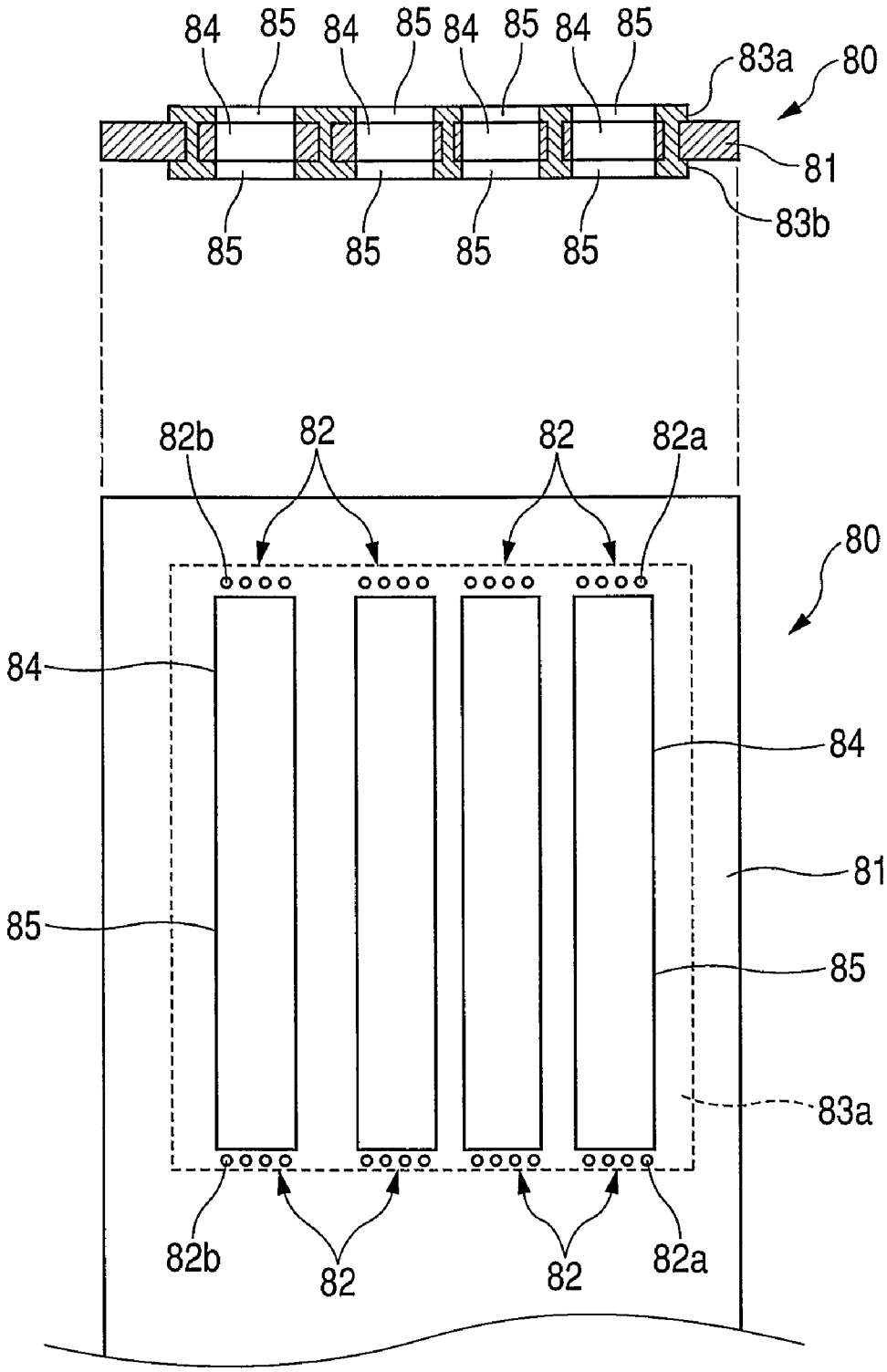
FIG. 9 is a schematic plan view showing another example of a flexible printed circuit.

A flexible printed circuit 80 shown in FIG. 9 comprises a base film 81, wiring patterns (not shown in the figure) that are formed on both the top and bottom sides of the base film 81 or on one side thereof, electrode terminals 82 that are electrically conducting with these wiring patterns, and copper foils 83*a* and 83*b* formed on both the top and bottom sides of the base film 81. In the base film 81, a plurality of elongated rectangular holes 84 are provided in the lengthwise direction in a condition in which they are juxtaposed in the width direction, and a plurality of electrode terminals 82 are formed at the two external sides of each rectangular hole 84 in the lengthwise direction. These electrode terminals 82 are disposed along the width direction of the base film 81 to form rows of electrodes, and each electrode terminal 82 is electrically conducting with a wiring pattern that is not shown in the figure. In the copper foils 83*a* and 83*b* provided on both the top and bottom sides of the base film 81 are formed openings 85 that communicate with each of the rectangular holes 84. The copper foils 83*a* and 83*b* penetrate the base film 81 to connect at two or more locations, and heat conduction is possible from one side to the other. Further, the copper foil 83*b* has an area larger than that of the liquid discharge substrate 2 as shown in FIG. 11 so that the heat of the liquid discharge substrate 2 can be dispersed and transferred to the supporting member 1 for heat dissipation.

Figure 10:
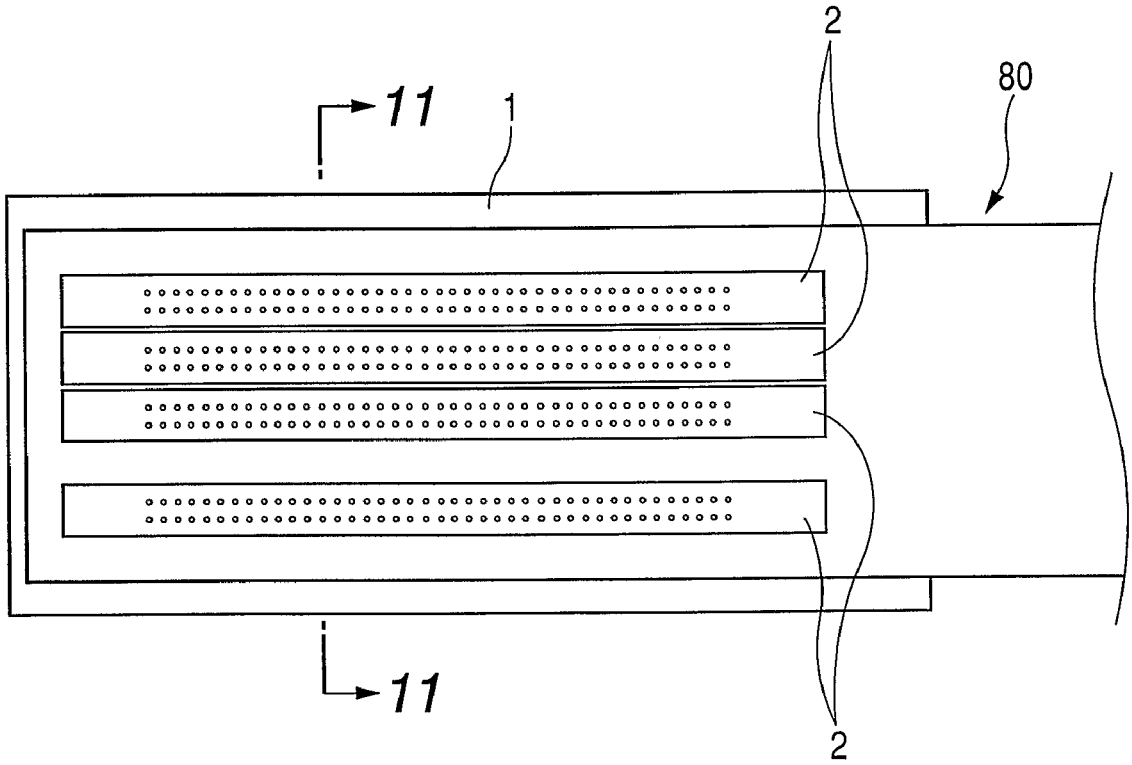
FIG. 10 is a schematic plan view showing another example of an embodiment of the recording head of this invention.
Figure 11:
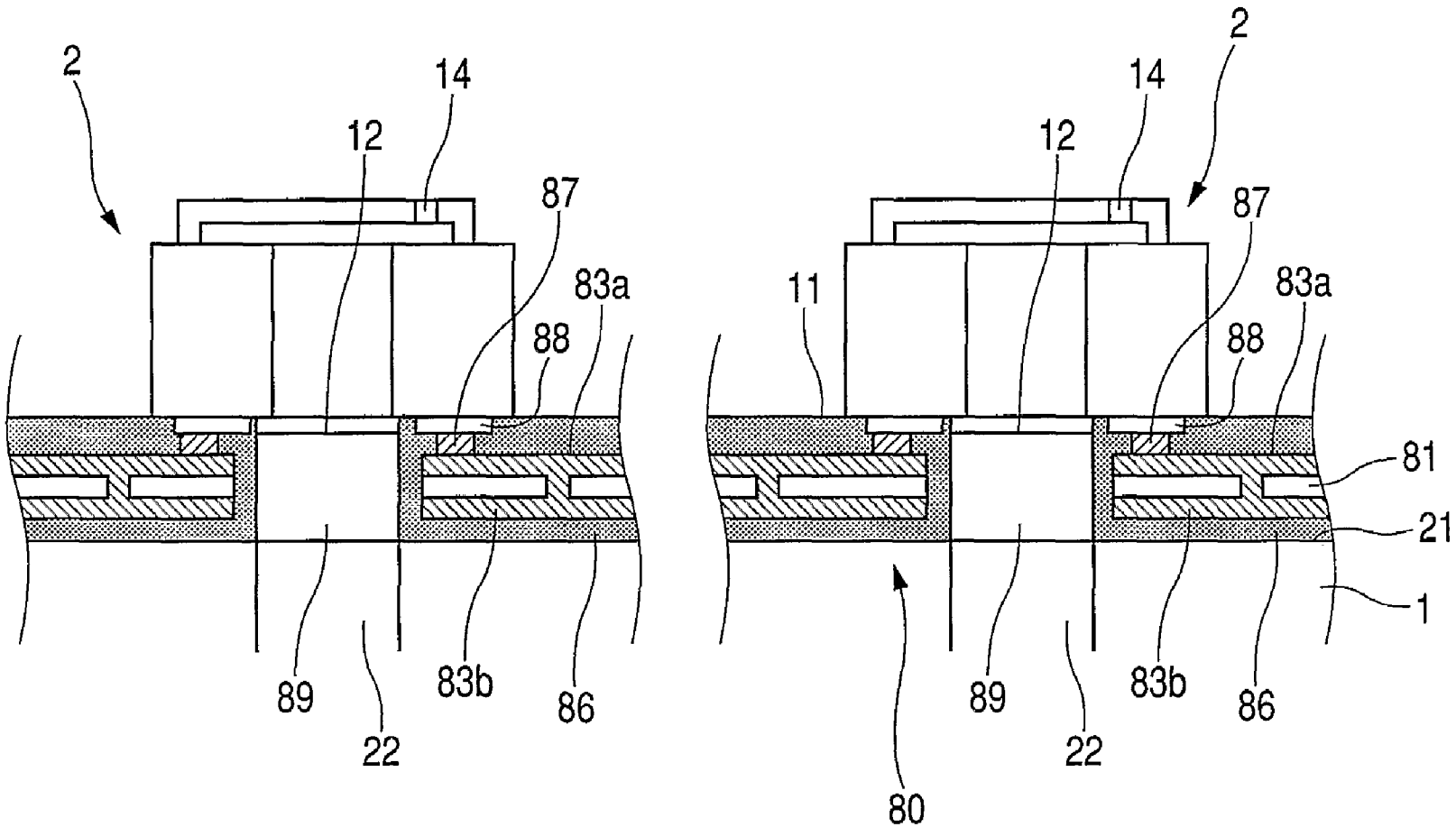
FIG. 11 is a schematic sectional view of a section cut along the line 11-11 shown in FIG. 10 of the recording head shown in the same figure.

Next, the structure of the recording head of this example is described referring to FIG. 10 and FIG. 11. FIG. 10 is a schematic plan view showing the recording head of this example, and FIG. 11 is an abbreviated schematic sectional view of a section along the line 11-11 of FIG. 10. As shown in these drawings, in the recording head of this example a plurality of the liquid discharge substrates 2 are mounted on the supporting member 1 through the flexible printed circuit 80 having the above-described structure, and the liquid supply port 12 of each of the liquid discharge substrates 2 communicates with the liquid supply holes 22 of the supporting member 1 through ink channels 89. More specifically, the copper foil 83*b* provided on the underside of the base film 81 is bonded to the top surface 21 or the supporting member 1 by a bonding agent 86. The copper foil 83*a* provided on the top surface of the base film 81 is bonded to a metallic thin film 88 that is provided on the underside 11 of the liquid discharge substrate 2 through heat-dissipating bumps 87. The ink channels 89 are formed by the boundary surfaces of the bonding agents 86. The thin film 88 is the same as the thin film 50 described in Embodiment 2.

In the recording head of this example having the above structure, the heat of the liquid discharge substrate 2 is conducted to the copper foil 83*a* through the thin film 88 and the heat-dissipating bumps 87 and diffused and dissipated, and is also conducted to the copper foil 83*b* for diffusion and dissipation. Further, heat that is conducted to the copper foil 83*b* is also conducted to the supporting member 1 and dissipated.

EMBODIMENT 5

Figure 12:
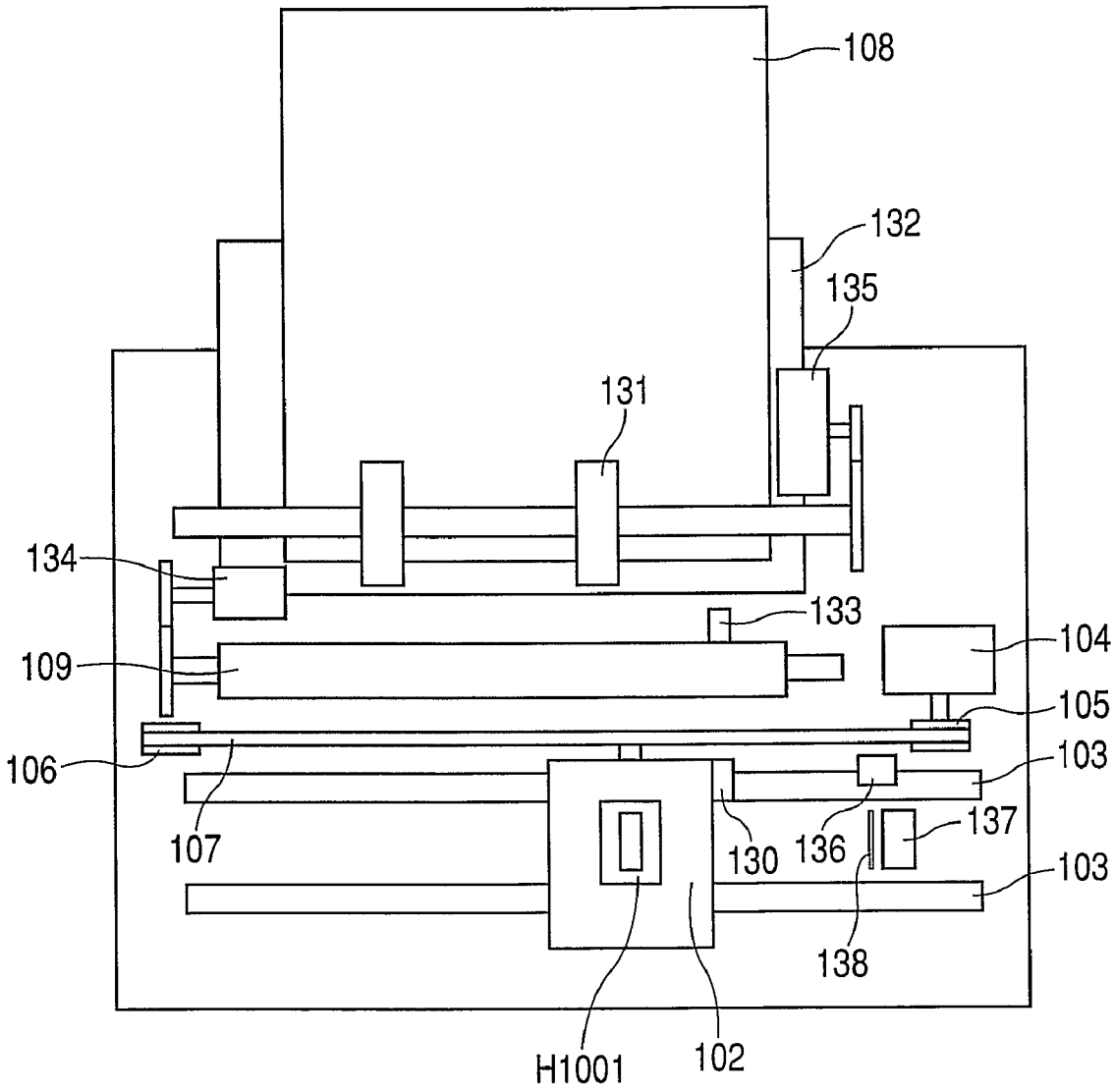
FIG. 12 is a schematic plan view showing one example of an embodiment of the recording apparatus of this invention.
Figure 13:
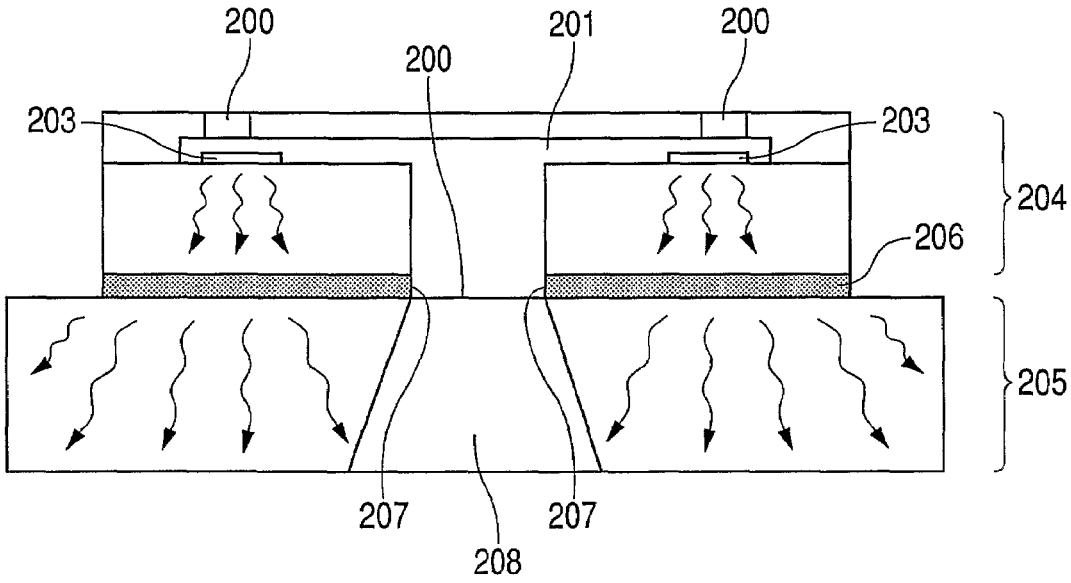
FIG. 13 is a schematic sectional view showing a conventional recording head.

Next, a recording apparatus (ink jet recording apparatus) that is capable of mounting the type of recording head described above is described as the fifth embodiment of this invention. FIG. 12 is an explanatory drawing showing one example of a recording apparatus that is capable of mounting the recording head of this invention.

In the recording apparatus shown in FIG. 12, a recording head H1001 as shown in Embodiments 1 to 4 is positioned and mounted in an exchangeable condition on a carriage 102, and the carriage 102 is provided with an electrical connection part (not shown) for transmitting driving signals and the like to the recording head H1001.

The carriage 102 is supported in a guided condition by guide shafts 103 that are provided in the main body of the apparatus extending in the main scanning direction. The carriage 102 is capable of moving back and forth along the guide shafts 103. The carriage 102 is driven by a main scanning motor 104 through a driving mechanism comprising a motorized pulley 105, a driven pulley 106 and a timing belt 107 and the like, and the position and movement of the carriage 102 are also controlled thereby. The carriage 102 is also equipped with a home position sensor 130. Thus, the apparatus can know the position when the home position sensor 130 on the carriage 102 has passed the location of a shield 136.

At the carriage position at which the home position sensor 130 detects the shield 136 (home position) is disposed a cap 137 that seals the face on which the discharge port of the recording head H1001 is formed. The cap 137 is used to execute an ink vacuum recovery operation for the recording head through an opening within the cap by vacuum means (not shown). The cap 137 can move by means of a driving force transmitted through a gear or the like, and is capable of covering the face that forms the discharge port. A cleaning blade 138 is provided in the vicinity of the cap 137. The apparatus is configured so that the respective operations of capping, cleaning and vacuum recovery are performed with respect to the face that forms the ink discharge port of the recording head when the carriage 102 has moved to the home position.

A recording medium 108 such as a recording paper or a plastic thin sheet is supplied from an auto sheet feeder (hereafter, referred to as "ASF") 132 by a pickup roller 131 that is driven in a rotational manner by a sheet feeding motor 135 after being separated into single sheets. The supplied recording medium 108 is transported (fed) through a position (print part) that faces the discharge port forming face of the recording head H1001 by a transport roller 109 rotated by the driving force of an LF motor 124 which is conveyed through a gear. At that time, determination as to whether or not the sheet was supplied and verification of the start position at the time of sheet feeding is performed when the recording medium 108 passes a paper end sensor 133. The paper end sensor 133 is also used for determining the actual location of the trailing end of the recording medium 108 and for ultimately determining the current recording position based on the actual trailing end.

In this connection, the underside of the recording medium 8 is supported by a platen (not shown) so that a flat printing surface is formed at the print part. In this case, the recording head H1001 mounted on the carriage 102 is supported so that the face that forms the discharge port thereof protrudes downwards from the carriage 102 to be parallel with the recording medium 108 between the above-described pair of transport rollers.

The recording head H1001 is mounted on the carriage 102 such that the direction of alignment of the discharge ports in each of the discharge port rows is a direction that intersects the above-described scanning direction of the carriage 102, to thus execute recording by discharging ink from the discharge port rows.

According to the ink jet recording head of each of the embodiments described in detail in the foregoing, since a foil-shaped heat dissipation member having an area larger than the projected area of a liquid discharge substrate with respect to a supporting member is disposed between the supporting member and the liquid discharge substrate, heat of the liquid discharge substrate is dissipated with a high degree of efficiency through the heat dissipation member and an increase in the substrate temperature is effectively suppressed.

This application claims priority from Japanese Patent Application No. 2004-214238 filed Jul. 22, 2004, which is hereby incorporated by reference herein.

The invention claimed is:

1. An ink jet recording apparatus comprising:

an ink jet recording head, including a supporting member comprising a liquid supply hole, a liquid discharge substrate comprising a liquid supply port communicating with the liquid supply hole, a discharge port from which liquid supplied from the liquid supply port is discharged, and discharge energy generation means that generates energy for discharging the liquid from the discharge port, wherein the liquid discharge substrate is mounted on the supporting member through a foil-shaped heat dissipation member, the area of the heat dissipation member is larger than a projected area of the liquid discharge substrate with respect to the supporting member, and the liquid discharge substrate is mounted on the supporting member through the heat dissipation member, and wherein the liquid discharge substrate and the supporting member are bonded by a bonding agent, and a channel is formed between the liquid supply port of the liquid discharge substrate and the liquid supply hole of the supporting member by boundary surfaces of the bonding agent; and a head retaining member that retains the ink jet recording head in a position facing a recording medium.

2. The ink jet recording apparatus according to claim 1, wherein the heat dissipation member is a member having a foil-shaped heat dissipation face.

3. An ink jet recording apparatus comprising:

an ink jet recording head including a supporting member comprising a liquid supply hole, and a liquid discharge substrate comprising a liquid supply port communicating with the liquid supply hole, a discharge port from which liquid supplied from the liquid supply port is discharged, and discharge energy generation means that generates energy for discharging the liquid from the discharge port, wherein the liquid discharge substrate is mounted on the supporting member through a foil-shaped heat dissipation member, the area of the heat dissipation member is larger than a projected area of the liquid discharge substrate with respect to the supporting member, and the liquid discharge substrate is mounted on the supporting member through the heat dissipation member, wherein the liquid discharge substrate comes into contact with the heat dissipation member through a bump; and a head retaining member that retains the ink jet recording head in a position facing a recording medium.

4. An ink jet recording apparatus comprising:

an ink jet recording head including a supporting member comprising a liquid supply hole, and a liquid discharge substrate comprising a liquid supply port communicating with the liquid supply hole, a discharge port from which liquid supplied from the liquid supply port is discharged, and discharge energy generation means that generates energy for discharging the liquid from the discharge port, wherein the liquid discharge substrate is mounted on the supporting member through a foil-shaped heat dissipation member, the area of the heat dissipation member is larger than a projected area of the liquid discharge substrate with respect to the supporting member, and the liquid discharge substrate is mounted on the supporting member through the heat dissipation member, and wherein a metal film provided on the liquid discharge substrate comes into contact with the heat dissipation member through a bump; and a head retaining member that retains the ink jet recording head in a position facing a recording medium.

5. An ink jet recording apparatus comprising:

an ink jet recording head including a supporting member comprising a liquid supply hole, and a liquid discharge substrate comprising a liquid supply port communicating with the liquid supply hole, a discharge port from which liquid supplied from the liquid supply port is discharged, and discharge energy generation means that generates energy for discharging the liquid from the discharge port, wherein the liquid discharge substrate is mounted on the supporting member through a foil-shaped heat dissipation member, the area of the heat dissipation member is larger than a projected area of the liquid discharge substrate with respect to the supporting member, and the liquid discharge substrate is mounted on the supporting member through the heat dissipation member, and wherein the heat dissipation member is formed on a film on which wiring patterns are formed for supplying driving signals to the discharge energy generation means; and a head retaining member that retains the ink jet recording head in a position facing a recording medium.

6. An ink jet recording apparatus comprising:

an ink jet recording head including a supporting member comprising a liquid supply hole, and a liquid discharge substrate comprising a liquid supply port communicating with the liquid supply hole, a discharge port from which liquid supplied from the liquid supply port is discharged, and discharge energy generation means that generates energy for discharging the liquid from the discharger port, wherein the liquid discharge substrate is mounted on the supporting member through a foil-shaped heat dissipation member, the area of the heat dissipation member is larger than a projected area of the liquid discharge substrate with respect to the supporting member, and the liquid discharge substrate is mounted on the supporting member through the heat dissipation member, and wherein two or more heat dissipation members are provided, and the two or more heat dissipation members are connected together to be capable of heat conduction therebetween; and a head retaining member that retains the ink jet recording head in a position facing a recording medium.

* * * * *